United States Patent [19]

Nischwitz et al.

[11] 4,136,218

[45] Jan. 23, 1979

[54] PROCESS FOR THE IMPROVEMENT OF THE WATER-ABSORBING CAPACITY AND THE ABSORPTIVITY OF TEXTILE MATERIALS

[75] Inventors: Ehrenfried Nischwitz, Schmitten-Oberreifenberg; Arno Holst, Wiesbaden; Ottokar Smerz, Kelkheim, Taunus; Michael Kostrzewa; Helmut Lask, both of Wiesbaden, all of Fed. Rep. of Germany

[73] Assignee: Hoechst Aktiengesellschaft, Frankfurt am Main, Fed. Rep. of Germany

[21] Appl. No.: 608,046

[22] Filed: Aug. 27, 1975

[30] Foreign Application Priority Data

Aug. 31, 1974 [DE] Fed. Rep. of Germany ..... 2441781

[51] Int. Cl.$^2$ ..... B05D 3/10

[52] U.S. Cl. ..... 427/339; 427/390 R; 427/412; 427/415

[58] Field of Search ..... 427/339, 415, 390 R, 427/412

[56] References Cited

U.S. PATENT DOCUMENTS

| | | | |
|---|---|---|---|
| 1,954,751 | 4/1934 | Bateman | 427/415 |
| 2,046,944 | 7/1936 | Hall | 427/415 |
| 2,131,882 | 10/1938 | Armor et al. | 427/415 |
| 2,259,847 | 10/1941 | Wallach | 427/415 |
| 3,870,542 | 3/1975 | Ida | 427/390 R |
| 3,965,091 | 6/1976 | Holst | 260/17 A |

*Primary Examiner*—Ronald H. Smith
*Assistant Examiner*—Janyce A. Bell
*Attorney, Agent, or Firm*—Connolly and Hutz

[57] ABSTRACT

Process for improving the water-absorbing capacity and absorptivity of fibrous materials consisting of, or containing, synthetic fibers or filaments, which comprises applying modified, highly absorbing cellulose ethers onto the fibrous materials and fixing these cellulose ethers on the fibrous material with the aid of finishing agents, resins or binders.

5 Claims, No Drawings

PROCESS FOR THE IMPROVEMENT OF THE WATER-ABSORBING CAPACITY AND THE ABSORPTIVITY OF TEXTILE MATERIALS

It is known that two-dimensional structures made of synthetic fibers, for example polyamide or polyester fibers and filaments, have a poor absorptivity and can store low amounts of water only. In this respect, the properties regarding utilization and, in particular, the wear of such textiles, are quite different from those of textiles made of cellulosic fibers such as cotton or fibers of regenerated cellulose or of wool.

Many attempts have been made to render fabrics or knit fabrics of synthetic fibers and filaments more hydrophilic. For example, attempts have been made to provide fabrics or knit fabrics with hydrophilic softeners or antistatics which increase the waterabsorption in addition to imparting onto them a softening and antistatic effect; however, these products did not provide permanent effects and the goods so finished were in most cases not fast to dropping.

Furthermore, attempts have been made to increase the waterabsorption of fabrics or knit fabrics by applying onto them watersoluble polyamides which still contained hydroxyl groups. However, also the effects obtained were insufficient and not permanent.

Furthermore, it has been tried to apply oxethylated polyester oligomers on, for example, polyester fabrics or mixed polyester fabrics in order also to improve the water-absorption of the fabrics in addition to producing an antistatic and soil-release effect. But these finishes, too, were insatisfactory and did not permit production of synthetic fiber fabrics having sufficient absorptivity.

If, in the production of non-woven textile materials from synthetic fibers or filaments, the materials are provided with a binder for synthetics, for example an acrylate copolymer or a vinylacetate polymer to make them suitable for utilization, the water-absorption of the materials inherent in the synthetic fibers is further impeded.

Such materials are used in quite many fields of application, for example as articles for hygienic purposes or cloths for cleaning purposes, and, therefore, they should be as adsorbing as possible and possess a good water-absorbing capacity. There have been made attempts to render such materials hydrophilic by applying onto them binders carrying hydrophilic groups, for example OH— or COOH— groups, but with a great number of hydrophilic groups the water-absorptivity was improved, whereas the fastness to washing was reduced. On the other hand, binders containing relatively few hydrophilic groups gave a sufficient permanence, but the water-absorption of the goods so treated was unsatisfactory.

Now, we have found that the water-absorbing capacity and the absorptivity of fabrics, knit fabrics or non-woven textile materials which consist of, or contain, synthetic fibers or filaments of, for example polyamides, polyesters or polyolefins such as polypropylene, can be improved by applying onto these fibrous materials a modified cellulose ether which itself has a high water-retaining capacity without being water-soluble. Since these modified cellulose ethers are not absorbed substantively by the fibers, it is suitable to apply them in combination with a finish, a synthetic resin or a binder.

The modified cellulose ethers to be used according to the invention are cellulose ethers which are water-insoluble to a large extent, i.e. more than 50% by weight water-insoluble, but which have a high absorptivity; their preparation is described, for example in German Offenlegungsschrift 23 58 150 (U.S. Pat. Appl. Ser. No. 524,822, now U.S. Pat. No. 3,965,091), which is hereby incorporated by reference.

This latter process is a process for the preparation of water-absorbing cellulose-ethers which, however, are insoluble in water to a large extent, i.e. to more than 50% by weight, in which cellulose is alkalized in the presence of alkali and 0.8 to 7.5 parts by weight, referred to the weight of the cellulose, of isopropanol as reaction medium and reacted with an etherifying agent to carboxymethyl cellulose, carboxymethyl-hydroxyethyl cellulose, hydroxethyl cellulose or methylhydroxyethyl cellulose in such a way that the resulting cellulose ether would have a water-solubility of at least 95% by weight, but which is modified either before, during or after etherification with a reagent which is reactive towards the still free hydoxyl groups of the cellulose anhydroglucose groups in an alkaline reaction medium and which corresponds to one of the formulae

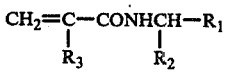

and

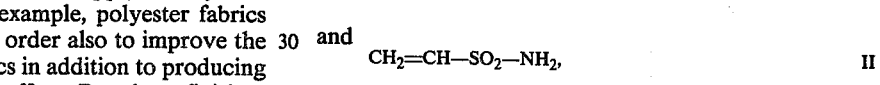

II in which in formula I $R_1$ represents the hydroxyl group, an alkanoylamino group or an alkoxycarbonylamino group, $R_2$ represents hydrogen or the carboxy group, $R_3$ represents hydrogen or methyl, preferably hydrogen, The modification agents used in this process are, for example:

N-(acrylamidomethylene)-acetamide,
N-(acrylamidomethylene)-formamide,
N-(acrylamidomethylene)-amylurethane,
N-(acrylamidomethylene)-methylurethane,
N-(acrylamido-carboxymethylene)-ethylurethane,
N-(acrylamidomethylene)-methoxyethylurethane,
vinyl-sulfonamide and, preferably,
N-methylolacrylamide.

Of these compounds, up to 100 parts by weight, preferably, however, less than 25 parts by weight, are applied on 100 parts by weight of cellulose.

These modified cellulose ethers used according to the invention still possess free methylol groups; therefore, they can be reacted with the aid of suitable substances which carry rests that are reactive towards methylol groups, for example amino or hydroxyl groups, and applied onto the fibrous materials. Such known products which contain reactive groups are the products conventionally used for the finishing of textile materials, in particular of cellulosic textile materials, for example condensation products of formaldehyde and urea, melamine and the derivatives of these compounds, or carbamates, as those described in "Textile World", December 1973, pages 48 to 52, and "Melliand Textilberichte" 41, (1960), pages 75 to 77.

Other products which are suitable for a reaction with the modified cellulose ethers and are also suitable for fixing them are the known copolymer dispersions on the basis of acrylic acid ester or of vinyl acetate. These copolymers used in the textile industry as finishing agents or binders in the preparation of fiber fleeces may contain, for example the following reactive groups:

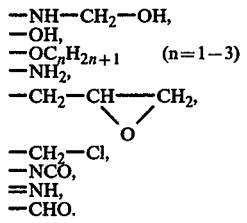

They are, in the first instance, acrylic acid esters or vinylacetate copolymers which may be built-up from the following monomers (proportions by weight):

(a)
- 10–90% of butyl-, ethyl- or octyl-acrylate,
- 0–30% of acrylonitrile,
- 0–10% of acryl- and/or methacrylamide,
- 0–5% of acryl- and/or methacrylic acid,
- 0–5% of N-methylolacrylamide or N-methylolmethacrylamide,
- 0–5% of glycidylacrylate or -methacrylate, (b)
- 10–99% of vinylacetate,
- 0–30% of dibutylmaleinate,
- 0–25% of ethylene,
- 0–15% of crotonic acid
- 0–25% of versatic acid ester,
- 0–5% of N-methylolacrylamide or -methacrylamide,
- 0–15% of chloroacetic acid vinyl ester;

the vinylacetate groups of these copolymers may be partially saponified.

The modified cellulose ethers used according to the invention are applied onto the fibrous material suitably together with the finishing agents, synthetic resins or other binders serving for their fixation on the fibrous material, from aqueous preparations such as solutions, dispersions or emulsions. The quantity of the modified cellulose ethers to be applied may vary within wide limits. Depending on the intended use of the fibrous material, the modified cellulose ethers are generally applied in quantities of from about 0.05, preferably 0.1 to 5% by weight, referred to the weight of the goods. The quantities applied of the finishing agents, synthetic resins or binders used simultaneously are within the ranges usual for these agents and are generally not changed by the cellulose ethers used at the same time.

Application of the baths containing these agents and the cellulose ethers onto the fibrous material can be carried out in the usual manner, for example by spraying, immersion or padding, or, optionally, by brushing on. After application of the baths containing the modified cellulose ethers, the fibrous materials are further treated in the manner usual for the fixation of the finishing agents, synthetic resin or fleece binders. In general, they are at first dried and then, for fixation, heated for a short time to elevated temperatures or allowed to dwell for a prolonged period of time at low temperatures.

The textile materials treated according to the invention with simultaneous use of modified cellulose ethers that have high water-absorbing capacity may be used in the most various fields of application. In addition to their use for wear articles, the materials treated according to the invention may find application as tissues for hygienic or cosmetic purposes and handkerchiefs. napkins, cleaning and dusting cloths, as textiles to be used in clinics, as diapers, as sweat bands for hats and caps, as shoe insert soles, and the like. By varying the quantity applied of modified cellulose ethers it is possible to regulate the degree of the water-absorbing capacity of the fibrous material according to the desired utilization.

If, for example, a polyester fiber fleece is reinforced with a commercial acrylate-copolymer dispersion of butyl acrylate, acrylonitrile, acrylic acid, diallyl phthalate and hexamethylolmelamine hexamethyl ether in a molar ratio of 95:4.8:2.9:0.3:5.0 in known manner, a fleece is obtained which, after cross-linking of the binder, has a very poor absorptivity. If, however, the impregnating bath, which usually contains about 300 to 500 g per liter of binder, about 1 to 10% by weight, preferably 2 to 5 % by weight, referred to the copolymer, of a cellulose ether modified with N-methylolacrylamide, the fleece becomes absorptive and its water-absorption rises, depending on the cellulose ether used and also depending on the quantity applied of this cellulose ether, to the 20 to 35 fold amount of absorption of a fleece treated in conventional manner without use of the modified cellulose ether. The handle of the fleeces is not changed by the addition of the cellulose ethers. The fastness to washing is altered to a minor degree only.

As compared to a normal fleece of viscose fibers the water-absorbing capacity of which has been strongly impeded by reinforcement with a known binder applied at the usual amount for binders of about 20 to 30% by weight, a fleece of the above kind, i.e. reinforced under addition of a modified cellulose ether, shows the advantage of a high water-absorbing capacity with fully maintained fastness.

Interlining materials and lining fabrics in the form of fabrics or fleeces of synthetic fibers, in particular of polyamide and polyester fibers, which in general are provided with a slight finish with a vinylacetate-homo- or copolymer dispersion, such as vinyl acetate-dibutyl maleinate in a weight proportion of 67:33 or an acrylate-copolymer dispersion such as that from ethylacrylate, acrylonitrile, acrylamide and acrylic acid in a weight proportion of 65:25:5:3, are scarcely capable of absorbing water. The addition of about 1 to 5% by weight, preferably 1 to 2% by weight, referred to the content of solids of the finish, of a modified cellulose ether considerably improves the water-absorbing capacity and therewith the wear properties of the goods so treated. The same applies to fabrics and knit fabrics of polyamides and polyesters, which are made into shirts, blouses, beddings or Jersey articles.

The absorptivity of cotton fabrics and cotton/polyester mixed fabrics which are finished so as to be crease-free or easy to care is strongly reduced by this finishing process which is generally carried out with reactant resins or condensation products of formaldehyde and melamine or urea or its derivatives. This disadvantage is avoided by adding to the finishing bath about 0.5 to 2% by weight, referred to the weight of the finishing resin, of a modified cellulose ether of the invention; the water-absorbing capacity and wear properties of the fabrics so finished are thereby distinctly improved.

Reinforced linings for lapels, collars or cuffs in the form of fabrics or fleeces of polyamide or polyester fibers, which have been stiffened by thick coatings of, for example polyvinyl-acetate polymers, reactant resins or polyvinyl alcohols that have been rendered water-insoluble were found to be particularly disagreeable during wear owing to their poor water-absorbing capacity and their lacking capacity of transporting away moisture. A distinct improvement of moisture absorption and therewith of the wear properties of these reinforced lining materials is obtained by adding to the stiffening finish about 0.5 to 2% by weight, referred to the content of solid of the finish, of a modified cellulose ether of the invention.

The following examples illustrate the invention.

EXAMPLE 1:

(a) A lining fleece of polyester fibers having a weight of 80 g/m$^2$ was immersed into an aqueous bath containing 300 g/l of a 40% self-cross-linking acrylate-copolymer dispersion of 92% by weight of ethyl acrylate, 4.8% by weight of acrylonitrile, 2.9% by weight of acrylic acid, 0.3% by weight of diallyl phthalate and 5.0% by weight of hexamethylene-melamine-hexamethyl ether. The excess bath was removed by a foulard and the fleece was dried at 105° C. and then cross-linked for 5 minutes at 140° C. A bound fleece having a coating of binder of about 20%, referred to the weight of the fibers, was obtained which could be used as intermediate lining material.

(b) The finishing process was carried out in the same manner, but adding to the immersion bath additionally 4.5 g/l of a hydroxyethyl cellulose modified with N-methylolacrylamide, preprepared according to Example 1 of German Offenlegungschrift No. 23 58 150 and pre-swelled in water.

The fiber fleeces obtained according to a) and b) were tested with regard to their absorptivity and water-absorbing capacity. The test for the water-absorbing capacity was carried out according to the regulations of the Technical Association of Pulp and Paper Industry (TAPPI, New York, T 441 m-60). The absorptivity was determined according to the procedure required in DIN 53 924 (German Industrial Standard). The results of these tests are compiled in the following Table 1.

Table 1:

| | a | b |
|---|---|---|
| Suction height (cm) | | |
| After 1 minute | 0 | 0 |
| 10 minutes | 0 | 1.5 |
| 30 minutes | 0 | 2.5 |
| Water absorption (g/m$^2$) | 6.5 | 189 |

EXAMPLE 2

A fabric of polyester staple fibers having a weight of 154 g/m$^2$ was impregnated with a bath of the following composition a), padded to a weight increase of 65% and dried at 110° C.:

(a) 20 g/l of a 50% of a finely divided, anionically dispersed vinylacetate homopolymer dispersion, 15 g/l of a condensation product of 1 mole of stearic acid and 10 moles of ethylene oxide (softener), 0.1 g/l of a carboxymethyl cellulose modified with N-methylol-acrylamide according to Example 3 of German Offenlegungsschrift No. 23 58 150.

In the same manner, polyester fiber fabrics were provided with a finish using impregnating baths which contained (b) 0.2 g/l of the modified carboxymethyl cellulose and (c) no proportions of the modified carboxymethyl cellulose.

The water-absorbing capacity of the fabrics so finished and that of a similar fabric which had not been provided with a finish (d) was tested. The results are compiled in the following Table:

Table 2

| | a | b | c | d |
|---|---|---|---|---|
| Water absorption (g/m$^2$) | 90 | 105 | 64 | 61 |

EXAMPLE 3

A knit fabric of texturated polyester endless filaments having a weight of 138 g/m$^2$ was provided with a finish in the same manner as described in Example 2 in order to improve the dimensionalstability and the handle. The fabrics treated were the same as those described in Example 2:

(a) finish produced using 0.1 g of the modified carboxymethyl cellulose, (b) finish produced using 0.2 g of the modified carboxymethyl cellulose, (c) finish produced without the modified carboxymethyl cellulose.

The water-absorbing capacities of the fabrics treated in this manner were tested according to the method prescribed by TAPPI:

Table 3:

| | a | b | c |
|---|---|---|---|
| Water absorption (g/m$^2$) | 192 | 194 | 178 |

In order to be provided with a finish, a mixed fabric of polyester fibers and cotton having a weight of 231 g/m$^2$ was padded with a finishing bath of the composition given below, dried at 105° C. and, for condensation, heated for 3 minutes to 150° C.

Finishing bath(a):

80 g/l of dimethylol-urea, 7 g/l of a reaction product of 1 mol of stearic acid and 10 moles of ethylene oxide (softener), 8 g/l of ethylenediamine hydrochloride, 0.5 g/l of hydroxyethyl cellulose modified with N-methyl-ol-acrylamide, prepared according to Example 5 of German Offenlegungsschrift No. 23 58 150.

In the same manner, finishes were produced with these finishing baths which, however, contained 1.0 g/l of the modified hydroxyethyl cellulose, (c) no proportions of the modified hyroxyethyl cellulose.

The water-absorbing capacity of the fabrics so finished was tested after the finishing process and after 5 fine washings carried out at 60° C.:

Table 4:

| Fabric | Water absorption (g/m$^2$) | |
|---|---|---|
| | Initial value | Value after 5 washings |
| a | 17 | 138 |
| b | 17 | 138 |
| c | 13 | 103 |

EXAMPLE 5

A mixed fabric of polyester fibers and staple fibers having a weight per m$^2$ of 188 g was impregnated with a bath having the following composition (a), padded and dried at 110° C.

Impregnating bath (a):

20 g/l of a 55% aqueous copolymer dispersion of 67 parts by weight of vinyl acetate and 33 parts by weight of dibutyl maleinate, 7 g/l of a reaction product of 1 mole of octadecyl-isocyanate and 1 mole of ethylene-imine, 0.1 g/l of carboxymethyl cellulose modified with N-methylol-acrylamide, prepared according to Example 5 of German Offenlegungsschrift No. 23 58 150.

For comparison, the finish was effected with a bath (b), which did not contain proportions of the modified cellulose ether.

The water-absorbing capacity of the fabrics so finished was tested directly after the finishing process and after 5 fine washings carried out at 60° C.:

Table 5:

| | Water Absorption ($g/m^2$) | |
|---|---|---|
| | Initial value | Value after 5 washings |
| a | 18 | 195 |
| b | 13 | 183 |

We claim:

1. Process for improving the water-absorbing capacity and absorptivity of fibrous materials containing synthetic fibers or filaments, which comprises applying modified, highly absorbing cellulose ethers onto the fibrous materials and fixing said cellulose ethers thereon with the aid of carbamate-based, linear or cyclic urea-formaldehyde reactants or acrylic acid ester- or vinylacetate-based copolymers containing reactive groups, said cellulose ethers being carboxymethyl cellulose, carboxymethyl-hydroxyethyl cellulose, methylhydroxyethyl cellulose or hydroxyethyl cellulose which are modified with a compound of the formula

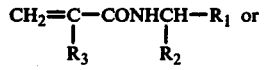

$$CH_2{=}\underset{\underset{R_3}{|}}{C}{-}CONH\underset{\underset{R_2}{|}}{CH}{-}R_1 \text{ or}$$

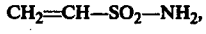

$$CH_2{=}CH{-}SO_2{-}NH_2,$$

in which in the first formula $R_1$ is hydroxyl, alkanoylamino or alkoxycarbonylamino, $R_2$ is hydrogen or carboxy and $R_3$ is hydrogen or methyl.

2. A process as claimed in claim 1 wherein the cellulose ether used is one which is water-soluble to at least 95% by weight prior to said modification.

3. A process as claimed in claim 1 wherein the amount of modified cellulose ether is from 0.05 to 5% by weight of the fibrous material.

4. A process as claimed in claim 1 wherein the cellulose ether is modified with N-methylol-acrylamide.

5. A process as claimed in claim 1 wherein the cellulose ether is hydroxyethyl cellulose or carboxymethyl cellulose modified with N-methylolacrylamide.

* * * * *